US010006450B2

(12) United States Patent
Nishido et al.

(10) Patent No.: US 10,006,450 B2
(45) Date of Patent: Jun. 26, 2018

(54) AIR COMPRESSOR

(71) Applicant: MAKITA CORPORATION, Anjo-shi (JP)

(72) Inventors: Noriyuki Nishido, Anjo (JP); Kenichi Miyata, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 388 days.

(21) Appl. No.: 14/858,271

(22) Filed: Sep. 18, 2015

(65) Prior Publication Data

US 2016/0090973 A1 Mar. 31, 2016

(30) Foreign Application Priority Data

Sep. 29, 2014 (JP) ..... 2014-198640

(51) Int. Cl.

| | |
|---|---|
| ***F04B 35/00*** | (2006.01) |
| ***F04B 35/02*** | (2006.01) |
| ***F04B 41/02*** | (2006.01) |
| ***F04B 35/04*** | (2006.01) |
| ***F04B 39/12*** | (2006.01) |
| ***F04B 35/06*** | (2006.01) |
| ***F04B 49/02*** | (2006.01) |
| ***F04B 49/06*** | (2006.01) |

(52) U.S. Cl.

CPC ..... *F04B 35/002* (2013.01); *F04B 35/04* (2013.01); *F04B 35/06* (2013.01); *F04B 39/121* (2013.01); *F04B 41/02* (2013.01); *F04B 49/02* (2013.01); *F04B 49/06* (2013.01); *F04C 2240/45* (2013.01)

(58) Field of Classification Search

CPC .... F04B 27/0895; F04B 35/00; F04B 35/002; F04B 35/02; F04B 35/04; F04B 35/06; F04B 41/02; F04C 2240/45; B60H 1/322; B60H 1/3222

See application file for complete search history.

(56) References Cited

U.S. PATENT DOCUMENTS

| | | | | |
|---|---|---|---|---|
| 4,293,281 | A * | 10/1981 | Lamoreaux | F04B 35/06 417/319 |
| 6,829,893 | B2 * | 12/2004 | Doerr | B60T 17/02 417/364 |
| 6,830,438 | B2 * | 12/2004 | Iwanami | B60H 1/322 417/16 |
| 7,207,784 | B2 * | 4/2007 | Sato | B60H 1/3222 417/222.1 |
| 9,206,793 | B2 * | 12/2015 | Lee | F04B 17/05 |

(Continued)

FOREIGN PATENT DOCUMENTS

JP 2003239863 A 8/2003

*Primary Examiner* — Peter J Bertheaud
(74) *Attorney, Agent, or Firm* — J-Tek Law PLLC; Jeffrey D. Tekanic; Scott T. Wakeman

(57) ABSTRACT

An air compressor includes an internal combustion engine for driving an air compressing part that generates compressed air, which is stored in an air-storage tank. At a point in time when the air pressure inside the air-storage tank has increased to a first set pressure, the supply of fuel to the engine is cut off, thereby stopping the engine and the combustion of fuel. At a point in time when the air pressure inside the air-storage tank has decreased from the first set pressure to a second set pressure, a starter motor is started up to resume the operation of the engine.

20 Claims, 4 Drawing Sheets

(56) References Cited

U.S. PATENT DOCUMENTS

2010/0158702 A1* 6/2010 Colavincenzo ..... F04B 35/002
417/16
2013/0058801 A1* 3/2013 Cheng ..... B60H 1/3208
417/212

* cited by examiner

AIR COMPRESSOR

CROSS-REFERENCE

This application claims priority to Japanese patent application serial number 2014-198640, filed on Sep. 29, 2014, the contents of which are incorporated herein by reference in its entirety.

TECHNICAL FIELD

The present invention generally relates to an air compressor for generating compressed air that may be supplied to a pneumatic tool such as a nailer.

BACKGROUND ART

Some known air compressors operate using an internal combustion engine as its motive-power source. Such air compressors comprise, in addition to the engine, an air-compressing part, such as a piston that is reciprocally slidable inside a cylinder, an air-storage tank, which stores compressed air discharged from the cylinder, and a pressure-detecting means, which detects the air pressure inside the air-storage tank. Such air compressors are configured such that, at the point in time when the air pressure inside the air-storage tank has increased to a set pressure, the engine is switched to an idling operation. For example, Japanese Laid-open Patent Publication 2003-239863 discloses a method for operating such an air compressor, in which compressed air generated during an idling operation is externally discharged and serves as a cooling air draft to cool a high-temperature component of the air compressor.

SUMMARY OF THE INVENTION

In the above-mentioned known air compressor, because the compressed air generated during an idling operation is not stored in the air-storage tank, it is wastefully generated from the standpoint that such compressed air is not used to drive the pneumatic tool.

Consequently, an object of the present teachings is to disclose a technique for reducing fuel consumption in an air compressor, which is driven at least in part by an internal combustion engine, by reducing or eliminating fuel consumption during an idle state.

In a first aspect of the present teachings, an air compressor includes an internal combustion engine (hereinafter sometimes referred to simply as "engine") serving as its motive-power source; an air-compressing part that is operated (driven) by the engine to generate compressed air; an air-storage tank for storing the compressed air discharged from the air-compressing part; and a pressure-detecting part (pressure detector/sensor) for detecting the air pressure inside the air-storage tank. In the first aspect of the present teachings, at the point in time when the air pressure inside the air-storage tank, as detected by the pressure-detecting part, reaches (has increased to) a first set (predetermined) pressure P1, the supply of fuel to the engine is cut off and thereby the engine is stopped, whereby the engine is put into an idle (off) state. Subsequently, at the point in time at which the air pressure inside the air-storage tank has decreased from the first set pressure P1 to a second (lower) set (predetermined) pressure P2, the engine is restarted and the generation of compressed air is restarted.

According to the first aspect of the present teachings, the engine stops at the point in time when the air pressure inside the air-storage tank has reached the first set pressure P1. Because the supply of fuel is cut off and thereby the engine is stopped, the consumption of fuel becomes zero, thereby avoiding the wasteful combustion of fuel in an idling operation and reducing overall fuel consumption.

In a second aspect of the present teachings, the air compressor further includes a starter motor for starting the engine; a battery, which serves as a power supply, that starts up (powers or energizes) the starter motor; and a control apparatus that controls the supply of current (electric power) from the battery to the starter motor and thereby controls the start of the engine.

According to the second aspect of the present teachings, at the point in time when the air pressure inside the air-storage tank has decreased from the first set pressure P1 to the second set pressure P2, the starter motor starts up and the engine restarts. In such embodiments, the battery that serves as the power supply of the starter motor may be configured to be alternately utilized as a battery pack for a rechargeable power tool, such as a cordless screwdriver or a cutting machine (e.g., a portable cordless saw). That is, the battery pack may comprise a plurality of battery cells disposed within a hard plastic case that is detachably attachable to a battery mounting part of a cordless power tool. The hard plastic case may include a pair of parallel slide rails to engage a corresponding set of guide rails on the air compressor when the battery pack is slid onto the guide rails. Battery terminals and optional signal communication terminals are preferably disposed between the slide rails to engage/contact corresponding terminals between the guide rails.

In a third aspect of the present teachings, the first set pressure P1 and/or the second set pressure P2 can be arbitrarily modified, e.g., changed at the discretion of the operator. For example, the control apparatus may be configured with a data storage (memory) for storing set values, such as one or more pressures, that may be altered or overwritten during operation in accordance with the circumstances, in which the air compressor is being used.

According to the third aspect of the present teachings, if the set (predetermined) value of the first set pressure P1 when the engine is stopped and/or the set (predetermined) value of the second set pressure P2 when the engine resumes, can be modified in an arbitrary manner, it is possible to operate the air compressor more quietly, when necessary, as well as increase the operating efficiency of the air compressor by adjusting the set values during operation based upon the particular usage conditions.

In a fourth aspect of the present teachings, an air compressor includes an internal combustion engine (again, hereinafter sometimes simply "engine") and an electric motor that are configured to alternately serve as the motive-power source. That is, the air-compressing part is configured to be operated (driven) by either the engine or the electric motor to generate compressed air. The air-storage tank stores the compressed air discharged from the air-compressing part and the pressure-detecting part (pressure detector or pressure sensor) detects the air pressure inside the air-storage tank. In the fourth aspect of the present teachings, the air-compressing part preferably operates using the electric motor (electric motor drive) as the motive-power source in a low-pressure range, in which the air pressure inside the air-storage tank, as detected by the pressure-detecting part, is lower than the pressure at a third set pressure P3. On the other hand, the air-compressing part preferably operates using the engine (engine drive) as the motive-power source in a high-pressure range, in which the air pressure inside the air-storage tank is higher than the pressure at the third set pressure P3.

According to the fourth aspect of the present teachings, a two-way-drive-type air compressor is provided that may be utilized in an engine-driven state and in motor-driven state. Thus, compressed air is generated using motive power provided by the electric motor in the low-pressure range (i.e. less than the third set pressure P3), and compressed air is generated using motive power provided by the internal combustion engine only in the high-pressure range (i.e. higher than the third set pressure P3). Consequently, fuel is not combusted when compressed air is being generated in the state in which the air pressure inside the air-storage tank is lower than the third set pressure P3, thereby greatly reducing the overall fuel consumption of the air compressor.

In a fifth aspect of the present teachings, the third set pressure P3 can be modified arbitrarily, e.g., it can be changed at the discretion of the operator, similar to the first and second set pressures P1 and P2 as described above.

According to the fifth aspect of the present teachings, by appropriately setting the timing (pressure) at which the source of motive power is switched from electric motor drive to engine drive, it is possible to maintain air-generation efficiency (air discharge capacity) in differing operating conditions while still reducing fuel consumption.

In a sixth aspect of the present teachings, the air compressor is configured such that, in the engine-driven state (wherein the air-compressing part is operated (driven) by the engine), the electric motor is caused to function as an electric generator to charge a battery, such as the above-described rechargeable power tool battery pack.

According to the sixth aspect of the present teachings, it is possible to operate the air compressor for a long time and to eliminate the need to remove the rechargeable battery so that it can be recharged using a separate charger. Thereby, the maintenance requirements and operating costs of the air compressor can be reduced.

DETAILED DESCRIPTION OF EMBODIMENTS

Figure 1:
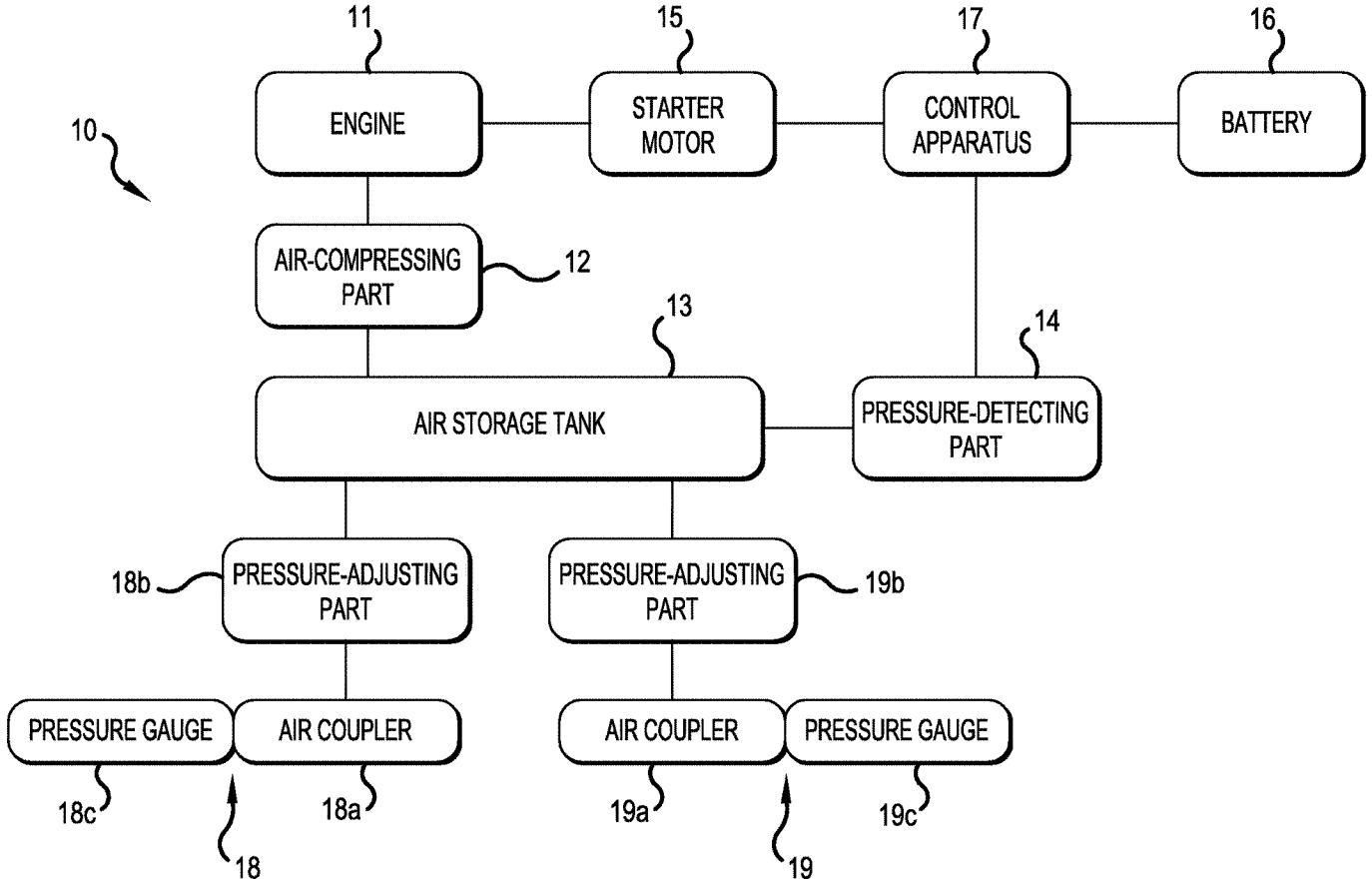
FIG. 1 is a block diagram that shows the configuration of an air compressor according to a first embodiment of the present teachings.

Representative, non-limiting embodiments of the present teachings will now be explained with reference to FIGS. 1-4. As shown in FIG. 1, an air compressor 10 according to the present embodiment generally comprises: an internal combustion engine 11, which serves as a motive-power source; an air-compressing part 12, which is driven by the motive power supplied by the engine 11 to generate compressed air; an air-storage tank 13 for storing the compressed air generated by the air-compressing part 12; and a pressure-detecting part 14 for detecting the air pressure inside the air-storage tank 13.

Internal combustion engines 11 according to the present teachings may be operated using a combustible fuel, such as a liquid fuel (e.g., gasoline, kerosene, etc.) or a gaseous fuel (e.g., methane, propane, hydrogen, etc.), in a known manner and the present teachings are not limited to any particular combustible fuel or to any particular design of the internal combustion engine 11. For example, the internal combustion engine 11 may comprise one or more pistons (respectively) disposed in one or more combustion cylinders and the piston(s) rotatably drive a crankshaft when the fuel is combusted in the cylinder(s).

The engine 11 may be a two-cycle internal-combustion engine and is started by a starter motor 15. The starter motor 15 starts up using (is powered or energized by) a battery 16 as its power supply. A control apparatus 17 controls the supply of current from the battery 16 to the starter motor 15. For example, based on an output signal from the control apparatus 17, the battery 16 supplies current (electric power) to the starter motor 15, so that the starter motor 15 starts up. When the starter motor 15 starts up, it causes the engine 11 to start, and compressed air is generated by the air-compressing part 12.

The air-compressing part 12 preferably comprises a cylinder having a piston slidably disposed therein. The piston reciprocally moves according to the motive power generated by fuel combustion in the cylinder of the engine 11, and thereby generates compressed air inside the cylinder. The generated compressed air is discharged from the cylinder, e.g., via a one-way value, and is stored in the air-storage tank 13. Naturally, the air-compressing part 12 may comprise two or more cylinders, each having a reciprocating piston slidably disposed therein.

The air pressure inside the air-storage tank 13 is detected by the pressure-detecting part 14, which may be or comprise a pressure sensor or pressure detector. The pressure sensor may be constructed using any known technology, such as but not limited to piezoresistive strain gauges, piezoelectric sensors, capacitive sensors, etc. The pressure sensor may optionally include a diaphragm that changes its position and/or shape with changes in pressure, which position/shape changes are detectable to generate a signal (air pressure signal) indicative of the pressure within the air-storage tank 13.

The air-storage tank 13 optionally may comprise a two-system output part, i.e. a high-pressure output part 18 and a conventional-pressure output part 19. The high-pressure output part 18 and the conventional-pressure output part 19 respectively comprise air couplers 18*a*, 19*a*, which serve as connection ports for connection with air hoses, pressure-adjusting parts 18*b*, 19*b*, and pressure gauges 18*c*, 19*c*. A pneumatic tool, such as a nailer, is connected to one of the air couplers 18*a*, 19*a* via an air hose.

In the high-pressure output part 18, high-pressure compressed air on the order of approximately 0.98-2.45 MPa (approximately 142-355 psi or 10-25 kgf/cm$^2$) can be output in accordance with the setting of the pressure-adjusting part (pressure regulator) 18*b*. In the conventional-pressure output part 19, compressed air on the order of approximately 0.39-0.88 Mpa (approximately 56-127 psi or 4-9 kgf/cm$^2$) can be output in accordance with the setting of the pressure-adjusting part (pressure regulator) 19*b*. The air pressures outputted thereby are displayed by the pressure gauges 18*c*, 19*c*.

Figure 2:
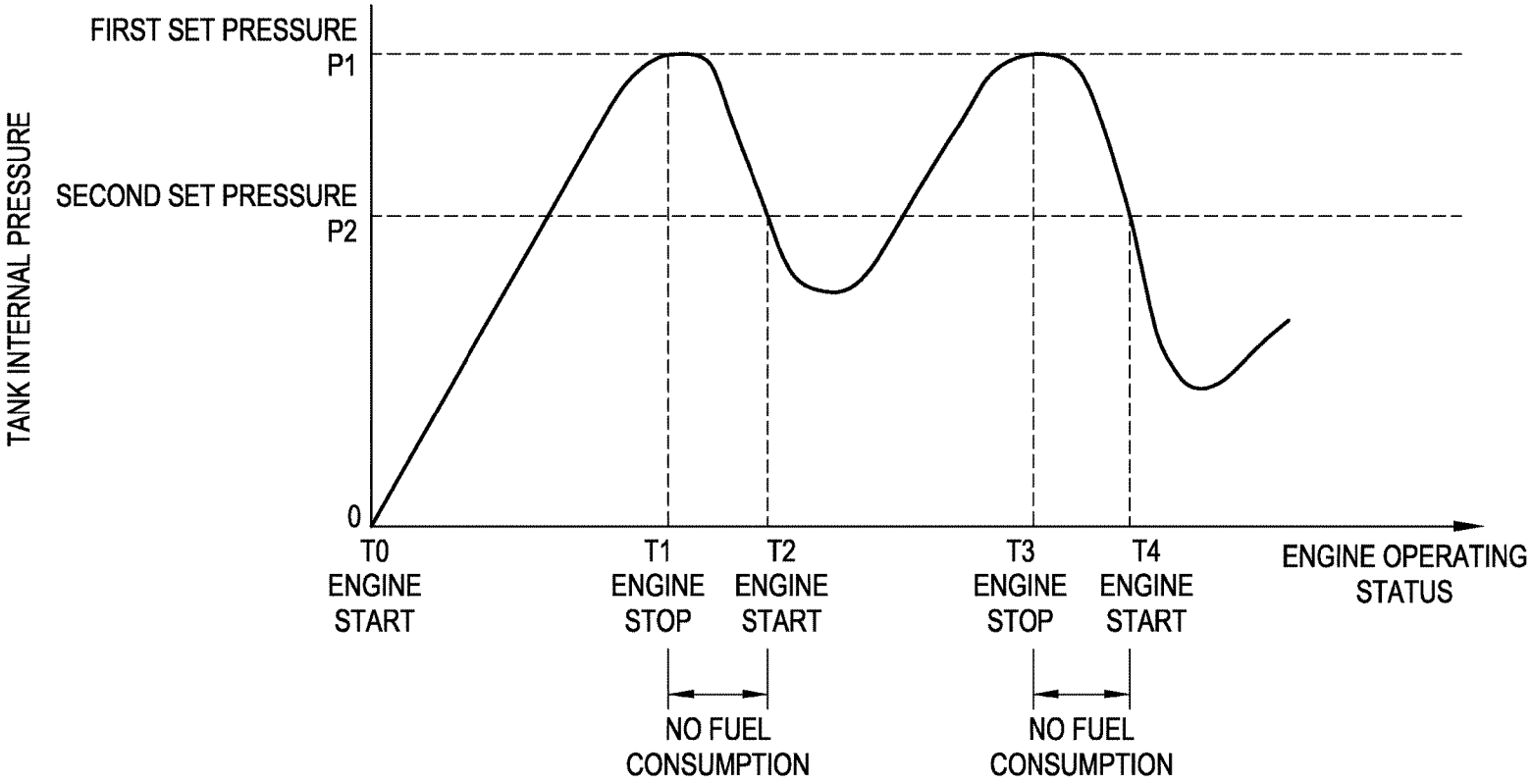
FIG. 2 is a graph of engine-startup control according to the first embodiment.

The control apparatus 17 controls the starting of the engine 11, as shown in FIG. 2. When the air pressure inside the air-storage tank 13 is initially zero, the starter motor 15 starts up and the engine 11 is started, and thereby compressed air is generated by the air-compressing part 12 and is stored inside the air-storage tank 13. By increasing the amount of compressed air stored inside the air-storage tank 13, the air pressure increases inside the air-storage tank 13 and is detected by the pressure-detecting part 14. As a result of the continued generation of compressed air by the air-compressing part 12, which is driven by the engine 11, the air pressure inside the air-storage tank 13 eventually reaches a predetermined first set pressure P1 (T0-T1).

The fact that the air pressure inside the air-storage tank 13 has reached the first set pressure P1 is detected by the pressure-detecting part 14, which outputs a detection signal (air pressure signal) to the control apparatus 17. Thereupon, the control apparatus 17 outputs an output signal, upon which the supply of fuel to the engine 11 is cut off and causes the engine 11 to stop running (T1).

After the engine 11 stops, the compressed air inside the air-storage tank 13 is discharged (e.g., due to the supply of compressed air to a pneumatic tool), thereby causing the air pressure to decrease (T1-T2). When the air pressure inside the air-storage tank 13 decreases to a predetermined second set pressure P2, this fact is detected by the pressure-detecting part 14, which outputs a detection signal (air pressure signal) to the control apparatus 17. The control apparatus 17 outputs a startup signal and a fuel-supply-start signal to the starter motor 15. Thereby, the starter motor 15 starts up again, the supply of fuel to the engine 11 resumes, and the engine 11 restarts (T2).

When the engine 11 restarts, the air-compressing part 12 once again generates compressed air to replenish the air-storage tank 13, and the air pressure detected by the pressure-detecting part 14 gradually increases in accordance therewith (T2-T3).

The air pressure inside the air-storage tank 13 once again increases and, when the air pressure reaches the first set pressure P1, this fact is detected by the pressure-detecting part 14, which outputs a detection signal (air pressure signal) to the control apparatus 17. At this stage, the fuel supply is again cut off and thereby the engine 11 once again stops (T3).

Because the engine 11 stops, the air-compressing part 12 no longer generates compressed air. Accordingly, when the air inside the air-storage tank 13 is discharged, the air pressure decreases gradually (T3-T4). When the air pressure inside the air-storage tank 13 once again decreases to the second set pressure P2, this fact is detected by the pressure-detecting part 14 and, based thereon, the control apparatus 17 outputs a fuel-supply-resume signal and a restartup signal for the starter motor 15, whereupon the engine 11 restarts (T4).

Thus, according to the air compressor 10 of the first embodiment, once the air pressure inside the air-storage tank 13 reaches the first set pressure P1, the engine 11 then remains in the stopped state (T1-T2, T3-T4), unless or until the air pressure decreases to the second set pressure P2. The engine 11 is stopped by cutting off the supply of the fuel. Consequently, unlike in the idling state of conventional air compressors, fuel consumption becomes zero, and therefore the fuel consumption (air-generation efficiency) of the air compressor 10 can be greatly improved.

Figure 3:
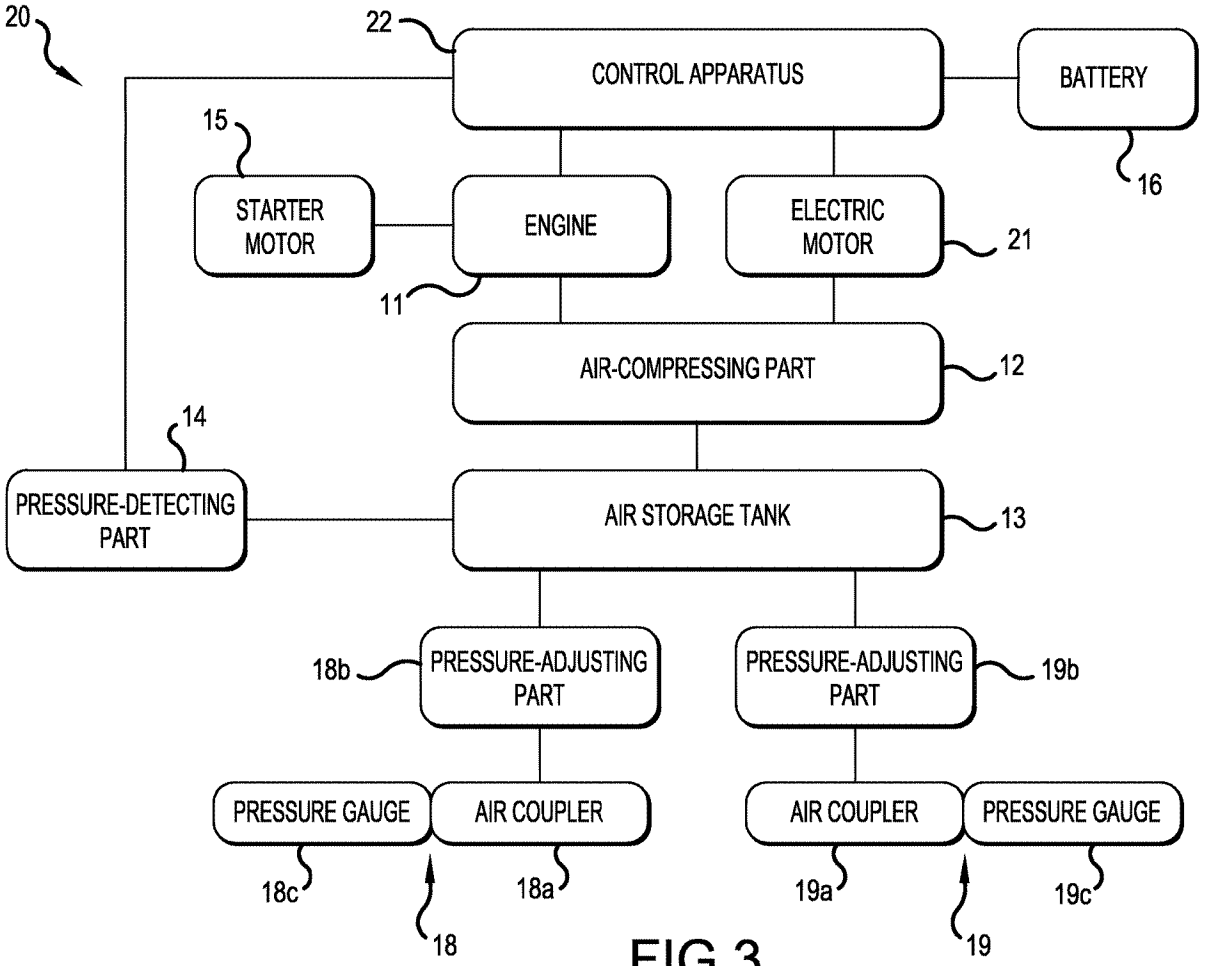
FIG. 3 is a block diagram that shows the configuration of the air compressor according to a second embodiment.

The above-described first embodiment uses the engine 11 as its sole motive-power source for operating (driving) the air-compressing part 12. However, as will be described below, the air compressor 20 of the second embodiment of the present teachings shown in FIG. 3 has a two-way-drive-type motive-power source that comprises, in addition to the engine 11, an electric motor 21. Both of the engine 11 and the electric motor 21 (hereinbelow, sometimes simply "motor 21") are configured to serve as the motive-power source to operate (drive) the air-compressing part 12. FIG. 3 shows the general configuration of the air compressor 20 of the second embodiment. Structural elements that are the same as those in the first embodiment are assigned the same reference numbers in FIG. 3, and explanations thereof are omitted.

Figure 4:
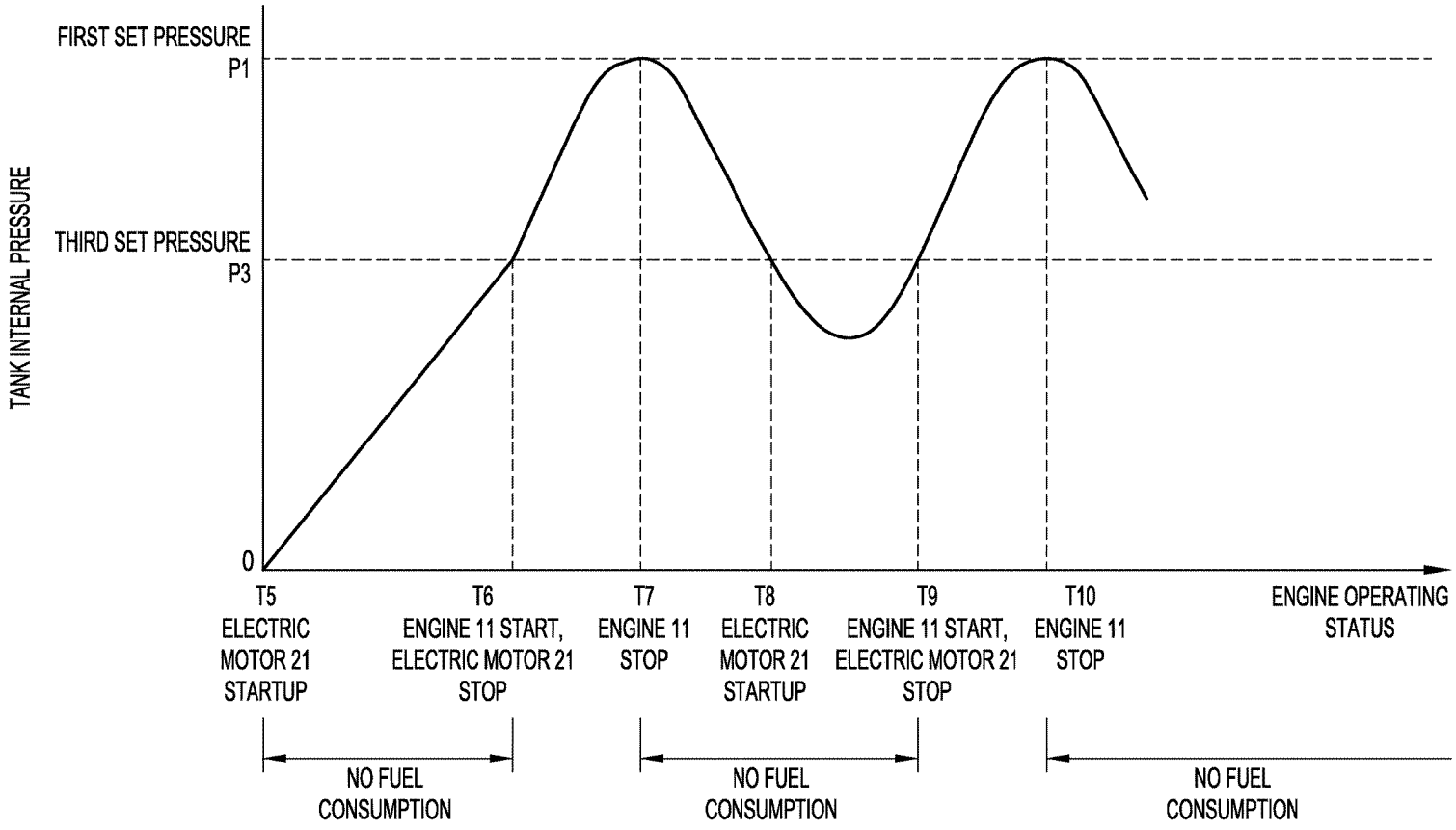
FIG. 4 is a graph of motive-power switch states according to the second embodiment.

The air compressor 20 of the second embodiment is configured to operate the air-compressing part 12 using either the engine 11 or the electric motor 21 as its motive-power source. The switching of the motive-power source is performed under the control of a control apparatus 22. FIG. 4 shows operation states of the air compressor 20 according to the second embodiment.

When the air pressure inside the air-storage tank 13 is initially zero, the electric motor 21 starts up. Owing to the startup of the electric motor 21, compressed air is generated by the air-compressing part 12 using the motive power supplied by the electric motor 21 and is stored inside the air-storage tank 13. As the amount of compressed air stored inside the air-storage tank 13 increases, the air pressure inside the air-storage tank 13 increases and is detected by the pressure-detecting part 14. As a result of the continued generation of compressed air by the air-compressing part 12 using the electric motor 21 as the motive-power source, the air pressure inside the air-storage tank 13 eventually reaches (increases to) a predetermined third set pressure P3 (T5-T6). The fact that the air pressure inside the air-storage tank 13 has reached the third set pressure P3 is detected by the pressure-detecting part 14, which outputs a detection signal (air pressure signal) to the control apparatus 22.

In response, the control apparatus 22 cuts off the supply of electric power (current) to the electric motor 21, and causes the electric motor 21 to stop running. At the same time or approximately the same time, the control apparatus 22 outputs a fuel-supply signal to the engine 11, and a startup signal to the starter motor 15. Thereby, the engine 11 starts up and continues the operation (driving) of the air-compressing part 12 (T6). The starter motor 15 preferably starts up using the battery 16 as its power supply, i.e. the control apparatus 22 outputs a signal that causes current to be supplied from the battery 16 to the starter motor 15.

Thus, after the motive-power source has switched from the electric motor 21 (electric motor compression) to the engine 11 (engine compression), the air-compressing part 12 continues to operate and generate compressed air, which is stored in the air-storage tank 13. The air-compressing part 12 is operated (driven) by the engine 11, and the air pressure inside the air-storage tank 13 eventually reaches (increases to) the predetermined first set pressure P1 (T7). Thus, in the low-pressure range (T5-T6) below the third set pressure P3, compressed air is generated using the electric motor 21 as the drive source, whereas in the high-pressure range (T6-T7) at or above the third set pressure P3, compressed air is generated using the engine 11 as the drive source. Consequently, in the low-pressure range below the third set pressure P3, the engine 11 is stopped and accordingly is in an operation state in which combustible fuel is not being consumed.

Thus, when the air pressure inside the air-storage tank 13 reaches the first set pressure P1, this fact is detected by the pressure-detecting part 14, which outputs a detection signal (air pressure signal) to the control apparatus 22. The control apparatus 22 outputs a signal to cut off the supply of fuel to the engine 11. Thereby, the engine 11 stops and the air-compressing part 12 stops generating compressed air.

During the time period between T7 and T8 shown in FIG. 4, both the engine 11 and the electric motor 21 are stopped, and an operation state results in which compressed air is not being generated. Moreover, in the time period after T7 until T9 (discussed below), the engine 11 is stopped and the operation state results in which combustible fuel is not being consumed.

As the compressed air is discharged, e.g., through operation of a pneumatic tool, the air pressure inside the air-storage tank 13 decreases (T8). When the air pressure inside the air-storage tank 13 decreases to the third set pressure P3, this fact is detected by the pressure-detecting part 14, which outputs a detection signal (air pressure signal) to the control apparatus 22. When the third set pressure P3 is detected at T8, the control apparatus 22 outputs a signal to start up the electric motor 21. As a result, the electric motor 21 starts up using the battery 16 as its power supply, and thereby the air-compressing part 12 restarts to generate compressed air again. Thereafter, the air pressure inside the air-storage tank 13 once again rises. When the pressure-detecting part 14 detects the fact that the air pressure inside the air-storage tank 13 has once again recovered to the third set pressure P3 at T9, the control apparatus 22 once again outputs an electric-motor-stop signal, and thereby the electric motor 21 stops. Furthermore, the control apparatus 22 starts up the starter motor 15 and thereby the engine 11 restarts, such that the motive power source once again switches (T9) from the electric motor 21 (electric motor compression) to the engine 11 (engine compression).

After T9, the engine 11 restarts, and thereby the air-compressing part 12 operates and the air pressure inside the air-storage tank 13 rapidly recovers. When the air pressure inside the air-storage tank 13 again increases (is restored) to the first set pressure P1 at T10, this fact is detected by the pressure-detecting part 14. When the first set pressure P1 is detected by the pressure-detecting part 14, a detection signal (air pressure signal) is output to the control apparatus 22, the supply of fuel to the engine 11 is once again cut off, and the engine 11 stops. Subsequently, as in T7-T9, the operation state results wherein combustible fuel is not being consumed.

Thus, according to the air compressor 20 of the second embodiment, the air-compressing part 12 is operated using a two-system motive-power source, that is, it has both an engine drive and an electric motor drive. The air-compressing part 12 operates (is driven) using the electric motor 21 as the motive-power source in the low-pressure range below the third set pressure P3, and the air-compressing part 12 operates (is driven) using the engine 11 as the motive-power source only in the high-pressure range at or above the third set pressure P3. Therefore, no fuel is consumed during the operation states (T5-T6, T8-T9) of the air-compressing part 12 in the low-pressure range below the third set pressure P3 in addition to the stopped state of the air-compressing part 12, and thereby the overall fuel consumption of the engine 11 can be greatly reduced.

Various changes and modifications can be made to the above-described embodiments without departing from the scope or spirit of the present teachings. For example, although a two-cycle engine 11 was exemplified as a motive-power source in the embodiments, a four-cycle engine may instead be utilized as (one of) the motive-power source(s). In addition or in the alternative, although embodiments were described in which the engine is stopped by the fuel supply being cut off, the air compressor (control apparatus) may be configured to stop the engine in some other manner such as cutting off the supply of electric power (current) to the spark plugs.

In addition or in the alternative, although embodiments were described in which the battery 16 is used as the power supply of the starter motor 15 for the engine 11, the air compressor may be configured such that an AC power supply, such as a 100-240V commercial AC power source (mains power supply), is used as the power supply instead of or in addition to the battery 16.

Furthermore, in the second embodiment, although the battery 16 is used as a common power supply, that is, as the power supply of the starter motor 15 of the engine 11 and also as the power supply of the electric motor 21, the air compressor (control apparatus) may be configured such that separate batteries are used as power supplies or may be configured such that a 100-240V commercial AC power source or the like is used as the power supply for one or both of the starter motor 15 and the electric motor 21.

In addition or in the alternative, although embodiments were described that comprise the starter motor 15 for starting the engine 11, the air compressor may be configured to use an engine that can be started by some means other than the starter motor.

In addition or in the alternative, although embodiments were described that comprise a two-system air-output part, that is, the high-pressure output part 18 and the conventional-pressure output part 19, the above-described motive-power control mode can likewise be applied to an air compressor having just one of the output parts or with three or more output parts that deliver compressed air at different pressures.

In addition or in the alternative, although the above-described embodiments utilize a reciprocating piston to generate compressed air within a cylinder, the structures for generating the compressed air are not particularly limited, and other types of compressed air generating structures may be utilized with the present teachings, such as rotary screw compressors, vane compressors, centrifugal compressors, etc.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved air compressors and methods of operating the same.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

Depending on design requirements, exemplary embodiments of the control apparatus (controller) 17, 22 of the present disclosure may be implemented in hardware and/or in software. The control apparatus (controller) 17, 22 can be configured using a digital storage medium, for example one or more of a ROM, a PROM, an EPROM, an EEPROM, a flash memory, etc., on which electronically readable control signals (program code) are stored, which interact or can interact with one or more programmable hardware components to execute programmed functions.

The (each) programmable hardware component can be formed by a processor, a computer processor (CPU=central processing unit), an application-specific integrated circuit (ASIC), an integrated circuit (IC), a computer, a system-on-a-chip (SOC), a programmable logic element, and/or a field programmable gate array (FGPA). A microprocessor is a typical component of a control apparatus (controller) according to the present teachings.

The digital storage medium can therefore be machine- or computer readable. Some exemplary embodiments thus comprise a data carrier or non-transient computer readable medium which includes electronically readable control signals which are capable of interacting with a programmable computer system or a programmable hardware component such that one of the methods or functions described herein is performed. An exemplary embodiment is thus a data carrier (or a digital storage medium or a non-transient computer-readable medium) on which the program for performing one of the methods described herein is recorded.

In general, exemplary embodiments of the present disclosure, in particular the control apparatus 17, 22 or a "controller", are implemented as a program, firmware, computer program, or computer program product including a program, or as data, wherein the program code or the data is operative to perform one of the methods when the program runs on (is executed by) a processor or a programmable hardware component. The program code or the data can for example also be stored on a machine-readable carrier or data carrier, such as any of the types of digital storage media described above. The program code or the data can be, among other things, source code, machine code, bytecode or another intermediate code.

A program according to an exemplary embodiment can implement one of the methods or function during its performance, for example, such that the program reads storage locations and/or writes one or more data elements into these storage locations, wherein switching operations or other operations are induced in transistor structures, in amplifier structures, or in other electrical, electronic, optical, magnetic components, or components based on another functional or physical principle. Correspondingly, data, values, sensor values, or other program information can be captured, determined, or measured by reading a storage location. By reading one or more storage locations, a program can therefore capture, determine or measure sizes, values, variables, and other information, as well as cause, induce, or perform an action by writing in one or more storage locations, as well as control other apparatuses, machines, and components, and thus for example also perform any complex process that the air compressor may be designed to perform.

Although some aspects of the present teachings have been described in the context of a device or apparatus, it is to be understood that these aspects also represent a description of a corresponding method, so that a block or a component of a device or apparatus is also understood as a corresponding method step or as a feature of a method step. In an analogous manner, aspects which have been described in the context of or as a method step also represent a description of a corresponding block or detail or feature of a corresponding device.

Additional modifications to the above-described embodiments include the following. For example, the above-described second embodiment may be configured to operate in accordance with the first embodiment in the event of a battery malfunction or insufficient remaining battery capacity. That is, the control apparatus 22 may be configured or programmed to monitor the condition of the battery 16, e.g., to determine discharge abnormalities, to check the remaining charge status and/or check whether the battery 16 is due for replacement due to normal wear on the battery cells. In the event that the control apparatus 22 determines for any reason that the battery 16 is not in a condition to reliably or safely drive the electric motor 21 when the pressure in the air-storage tank 13 drops to the third set pressure P3, the control apparatus 22 may cause the air-compressing part 12 to be driven using the engine 11 as the sole motive source when the pressure inside the air-storage tank 13 drops to the second set pressure P2. Thus, the electric motor 21 is not driven by the battery 16 when the battery 16 is not in a condition to reliably or safely supply current to the electric motor 21.

In addition or in the alternative, a commercial power supply may be used instead of the battery 16 in second embodiment when available. Thus, the air compressor 10 may be provided with a power cord having a plug for insertion into a socket of the commercial power supply, and an AC/DC converter. Therefore, when commercially-available AC power is readily available, the control apparatus 22 may be configured to use the commercially-available AC power to drive the electric motor 21 instead of the battery 16, thereby reducing wear and tear on the battery 16.

In the second embodiment, a clutch optionally may be disposed between engine 11 and air-compressing part 12 so that the air-compressing part 12 may be disconnected from the engine 11 (e.g., from a crankshaft thereof) while the electric motor 21 is driving the air-compressing part 12, thereby reducing the load on the battery 16.

Furthermore, in the second embodiment, a clutch optionally may be disposed between the electric motor 21 and air-compressing part 12 so that the air-compressing part 12 may be disconnected from the electric motor 21 while the engine 11 is driving the air-compressing part 12, thereby reducing the load on the engine 11 and reducing fuel consumption. For example, the clutch may disengage the electric motor 21 from the air-compressing part 12 and from the engine 11 when the battery 16 is in a fully charged state. Otherwise, some of the rotational energy generated by the engine 11 may be utilized to drive the electric motor 21, so that it acts as a generator (or alternator) to recharge the battery 16.

In a further modification of the second embodiment, the control apparatus 22 may be configured or programmed to cause the electric motor 21 to drive the air-compressing part 12 until the pressure inside the air-storage tank 13 reaches or exceeds a fourth set pressure P4, which is higher than the third set pressure P3 but less than the first set pressure P1. In such an embodiment, the control apparatus 22 then causes the electric motor 21 to stop operating when the fourth set pressure P4 has been reached and to drive the air-compressing part 12 using the engine 11 until the air-pressure inside the air-storage tank 13 reaches or exceeds the first set pressure P1. This embodiment provides a type of hysteresis, so that the air-compressing part 12 is driven by the electric motor 21 for a longer period of time than in the second embodiment. Because electric motors generally operate more quietly than internal combustion engines, this modification of the second embodiment may be advantageously utilized when quieter operation is desired.

In such a modification, the fourth set pressure P4 may be, e.g., 10% greater than the third set pressure P3, or e.g., 15%, 20%, 25%, 30% or more than the third set pressure P3.

In addition or in the alternative, the control apparatus 22 may monitor the discharge of compressed air from air-storage tank 13 and modify, e.g., reduce, the fourth set pressure P4 in the event the control apparatus 22 determines that compressed air is being actively discharged. In this case, the engine 11 may begin operating earlier in order to drive the air-compressing part 12 while the user is actively operating a pneumatic tool, thereby avoiding the possibility that the battery 16 is overloaded driving the electric motor 21 at the same time that compressed air is being discharged from the air-storage tank 13. On the other hand, if the control apparatus 12 determines that compressed air is not actively being discharged from the air-storage tank 13, the battery 16 and electric motor 21 may be utilized to drive the air-compressing part 12 until the air pressure reaches the third set pressure P3 (in the second embodiment) or the third set pressure P4 (in the modification thereof), so that quieter operation of the air compressor 10 is extended as long as possible.

EXPLANATION OF THE REFERENCE NUMBERS

10 Air compressor (first embodiment)
11 Engine
12 Air-compressing part
13 Air-storage tank
14 Pressure-detecting part
15 Starter motor
16 Battery
17 Control apparatus
18 High-pressure output part
18*a* Air coupler
18*b* Pressure-adjusting part
18*c* Pressure gauge
19 Conventional-pressure output part
19*a* Air coupler
19*b* Pressure-adjusting part
19*c* Pressure gauge
20 Air compressor (second embodiment)
21 Electric motor
22 Control apparatus

The invention claimed is:

1. An air compressor comprising:
an internal combustion engine serving as a first motive-power source;
an electric motor serving as a second motive-power source;
an air-compressing part drivable by the internal combustion engine or the electric motor to generate compressed air;
an air-storage tank configured to store the compressed air discharged from the air-compressing part;
a pressure-detecting part configured to detect the air pressure inside the air-storage tank; and
a control apparatus configured such that:
the air-compressing part is driven by the electric motor as the second motive-power source in a low-pressure range, in which the air pressure inside the air-storage tank, as detected by the pressure-detecting part, is lower than the pressure at a first set pressure P3;
the air-compressing part is driven by the internal combustion engine as the first motive-power source in a high-pressure range, in which the air pressure inside the air-storage tank is higher than the pressure at the first set pressure P3; and
when the first set pressure P3 is exceeded, the electric motor is shut off and the internal combustion engine is automatically started to drive the air-compressing part.

2. The air compressor according to claim 1, wherein the first set pressure P3 is arbitrarily modifiable.

3. The air compressor according to claim 1, wherein the electric motor is configured to act as an electric generator and charge a battery configured to supply current to drive the electric motor when the air-compressing part is being driven by the engine.

4. The air compressor according to claim 3, wherein the battery is housed in a hard plastic case having a pair of parallel slide rails configured to be detachably attached to a cordless screwdriver or a cordless cutting machine.

5. An air compressor comprising:
an internal combustion engine;
an electric motor;
an air-compressing part drivable by the engine and/or the electric motor to generate compressed air;
an air-storage tank configured to store the compressed air generated by the air-compressing part;
a pressure sensor configured to detect the air pressure inside the air-storage tank; and
a controller configured to:
receive an air pressure signal from the pressure sensor;
cause the electric motor to drive the air compressing part when the air pressure signal is less than a first preset pressure;
cause the electric motor to stop driving the air compressing part and cause the internal combustion engine to start up and drive the air compressing part when the air pressure signal is between the first preset pressure and a second preset pressure that is higher than the first preset pressure; and
stop operation of the internal combustion engine when the air pressure signal exceeds the second preset pressure.

6. The air compressor according to claim 5, wherein the controller is further configured to cause the electric motor to restart and drive the air compressing part, after the air pressure signal has fallen below the first preset pressure, until the first preset pressure is reached again.

7. The air compressor according to claim 6, further comprising a rechargeable battery configured to supply current to drive the electric motor.

8. The air compressor according to claim 7, wherein:
the internal combustion engine is configured to drive the electric motor and
the electric motor is configured to charge the rechargeable battery when the internal combustion engine is operating between the first preset pressure and the second preset pressure.

9. The air compressor according to claim 8, further comprising a starter motor configured to start up operation of the internal combustion engine.

10. The air compressor according to claim 9, wherein the starter motor is configured to be powered by the rechargeable battery.

11. The air compressor according to claim 10, wherein the rechargeable battery is housed in a battery pack configured to be detachably attached to an electric power tool.

12. The air compressor according to claim 11, wherein the air-compressing part comprises a piston that is reciprocally movable within a cylinder to generate the compressed air.

13. The air compressor according to claim 5, further comprising a rechargeable battery configured to supply current to drive the electric motor.

14. The air compressor according to claim 13, wherein:

the internal combustion engine is configured to drive both the air-compressing part and the electric motor and the electric motor is configured to charge the rechargeable battery when the internal combustion engine is operating between the first preset pressure and the second preset pressure.

15. The air compressor according to claim 5, further comprising a starter motor configured to start up operation of the internal combustion engine.

16. The air compressor according to claim 15, wherein the starter motor is configured to be powered by a rechargeable battery.

17. The air compressor according to claim 16, wherein the rechargeable battery is housed in a battery pack configured to be detachably attached to an electric power tool.

18. The air compressor according to claim 5, wherein the air-compressing part comprises a piston that is reciprocally movable within a cylinder to generate the compressed air.

19. The air compressor according to claim 5, wherein the first preset pressure is arbitrarily modifiable.

20. The air compressor according to claim 13, wherein the rechargeable battery is housed in a hard plastic case having a pair of parallel slide rails configured to be detachably attached to a cordless screwdriver or a cordless cutting machine.

* * * * *